US011027951B2

(12) United States Patent
Fuehrle et al.

(10) Patent No.: US 11,027,951 B2
(45) Date of Patent: Jun. 8, 2021

(54) LIFTING DEVICE AND METHOD FOR STARTING UP THE HOISTING GEAR OF SUCH A LIFTING DEVICE

(71) Applicant: Liebherr-Components Biberach GmbH, Biberach an der Riss (DE)

(72) Inventors: Stefan Fuehrle, Attenweiler (DE); Harald Wanner, Mietingen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 123 days.

(21) Appl. No.: 16/531,936

(22) Filed: Aug. 5, 2019

(65) Prior Publication Data

US 2020/0017340 A1 Jan. 16, 2020

Related U.S. Application Data

(63) Continuation of application No. PCT/EP2017/084741, filed on Dec. 28, 2017.

(30) Foreign Application Priority Data

Feb. 9, 2017 (DE) ..... 10 2017 001 238.5

(51) Int. Cl.
*B66C 13/16* (2006.01)
*B66D 1/50* (2006.01)
(Continued)

(52) U.S. Cl.
CPC ..... *B66D 1/505* (2013.01); *B66C 13/16* (2013.01); *B66C 13/18* (2013.01); *B66D 5/30* (2013.01); *B66C 13/22* (2013.01)

(58) Field of Classification Search
CPC ..... B66C 9/02; B66C 11/12; B66C 11/24; B66C 13/06; B66C 13/063; B66C 13/085;
(Continued)

(56) References Cited

U.S. PATENT DOCUMENTS 2,746,583 A * 5/1956 Blevins ..... B66D 5/00 477/23
4,113,237 A 9/1978 Derrwaldt
(Continued)

FOREIGN PATENT DOCUMENTS

CN 86104940 2/1988
CN 102040161 5/2011
(Continued)

*Primary Examiner* — Emmanuel M Marcelo
(74) *Attorney, Agent, or Firm* — Levine Bagade Han LLP

(57) ABSTRACT

The present invention relates to a lifting device for example in the form of a crane such as a tower crane, with a hoisting gear comprising a hoisting cable which runs off from a drum that can be driven by a hoisting gear drive, and a hoisting gear brake for holding the hoisting cable in a braked position. The invention furthermore relates to a method for starting up the hoisting gear of such a lifting device from the braked position in which the hoisting gear brake holds a hoisting load, wherein a starting torque is built up by a hoisting gear drive against the closed hoisting gear brake, and the hoisting gear brake is released upon or after reaching the starting torque. According to the invention it is proposed that when the hoisting gear brake is closed, the current hoisting load is detected by means of a load detection device and the starting torque is adjusted by the hoisting gear controller with reference to the detected current hoisting load such that the hoisting force provided by the starting torque of the hoisting gear corresponds to the detected, current hoisting load.

20 Claims, 2 Drawing Sheets

(51) Int. Cl.
*B66C 13/18* (2006.01)
*B66D 5/30* (2006.01)
*B66C 13/22* (2006.01)

(58) Field of Classification Search
CPC ..... B66C 13/16; B66C 13/22; B66C 13/44; B66D 1/46; B66D 1/485; B66D 1/54; B66D 1/505
See application file for complete search history.

(56) References Cited

U.S. PATENT DOCUMENTS 5,049,793 A * 9/1991 Tanaka ..... H02P 3/04 318/436
2002/0033481 A1* 3/2002 Kemppainen ..... B66C 13/23 254/275
2002/0144868 A1* 10/2002 Kuivamaki ..... F16D 67/02 188/71.9
2008/0157042 A1* 7/2008 Jacobson ..... B66B 9/00 254/270
2010/0187046 A1* 7/2010 Stolt ..... H02P 29/02 187/293
2016/0347592 A1* 12/2016 Golder ..... H02K 49/065
2018/0254729 A1* 9/2018 Byun ..... H02P 21/04

FOREIGN PATENT DOCUMENTS

DE 883057 B 7/1953
DE 1181883 11/1964
DE 2231997 6/1972
DE 9315641 2/1994
DE 19956265 6/2005
EP 0779239 6/1997
EP 0798488 10/1997
EP 3072845 9/2016
JP 2013-23294 A * 2/2013 ..... B66C 13/22
WO WO 2011/120393 10/2011
WO WO 2018/145806 8/2018

* cited by examiner

LIFTING DEVICE AND METHOD FOR STARTING UP THE HOISTING GEAR OF SUCH A LIFTING DEVICE

CROSS-REFERENCE TO RELATED APPLICATIONS

This application is a continuation of International Patent Application Number PCT/EP2017/084741 filed Dec. 28, 2017, which claims priority to German Patent Application Number 10 2017 001 238.5 filed Feb. 9, 2017, the contents of which are incorporated herein by reference in their entireties.

BACKGROUND OF THE INVENTION

The present invention relates to a lifting device for example in the form of a crane such as a tower crane, with a hoisting gear comprising a hoisting cable which runs off from a drum that can be driven by a hoisting gear drive, and a hoisting gear brake for holding the hoisting cable in a braked position. The invention furthermore relates to a method for starting up the hoisting gear of such a lifting device from the braked position in which the hoisting gear brake holds a hoisting load, wherein a starting torque is built up by a hoisting gear drive against the closed hoisting gear brake, and the hoisting gear brake is released upon or after reaching the starting torque.

In hoisting gears of lifting devices such as cranes the opening of the hoisting gear brake represents a great challenge for the control and regulating technique. On opening of the hoisting gear brake, the hoisting gear drive must abruptly take over the load attached to the load hook. To avoid any major instabilities and dynamic pendular movements, a specified starting torque usually is built up by the hoisting gear drive against the closed brake already before releasing the hoisting gear brake, so that the hoisting gear drive already provides a hoisting force acting against the load when the hoisting gear brake is released. On opening of the brake, the load nevertheless moves slightly upwards or slightly downwards, depending on whether the starting torque is greater or smaller than the torque induced by the hoisting load. In cranes such as tower cranes or telescopic cranes or other cranes which due to long, slender structures and large cantilever lengths are sensitive to jerky movements and abrupt dynamic load changes, however, even minor sagging movements of the load or too strong hoisting forces of the hoisting gear on release of the brake can lead to instabilities which can result in pendular movements and jerky load movements. This not only can impair the crane itself, but can also be problematic for the load guided on the load hook, for example when the load is mounted to another component and in doing so is held by the load hook.

When the hoisting gear brake is opened after building up the starting torque, the control circuit of the hoisting gear controller must correct occurring up and down movements of the load until the load is exactly held in position. For this purpose, the motor torque usually is adjusted or regulated via the frequency converter with which the hoisting gear drive is actuated such that undesired up and down movements of the load hook subside and the load is held exactly in position.

BRIEF SUMMARY OF THE INVENTION

It is the object underlying the present invention to create an improved lifting device and an improved method for starting up the hoisting gear of such a lifting device from the braked position, which avoid disadvantages of the prior art and develop the latter in an advantageous way. In particular, opening of the hoisting gear brake and starting up from the braked position should be enabled as far as possible without any undesired load movements or with load movements as small as possible.

According to the invention, said object is achieved by the methods and lifting devices disclosed.

Hence, it is proposed not to build up a specified fixed starting torque before releasing the hoisting gear brake, but to individually adapt the starting torque to the respectively attached load and load situation and variably adjust the same in order to eliminate or minimize deviations between the hoisting force, which the hoisting gear provides by the starting torque, and the actually acting load. According to the invention it is proposed that when the hoisting gear brake is closed, the current hoisting load is detected by means of a load detection device and the starting torque is adjusted by the hoisting gear controller with reference to the detected current hoisting load such that the hoisting force provided by the starting torque of the hoisting gear corresponds to the detected, current hoisting load. When the hoisting gear brake then is released after the hoisting gear drive has built up the starting torque against the closed brake, the hoisting load is balanced out with the hoisting force provided by the starting torque so that undesired pendular movements can be avoided. By individually adapting the starting torque to various hoisting load situations, a considerably smoother start-up from the braked position can be achieved. When a larger hoisting load is attached to the load hook, a larger starting torque is provided. On the other hand, when only a smaller hoisting load is braked, a smaller starting torque is provided for start-up.

In an advantageous development of the invention the detection of the current hoisting load not only takes account of the net load picked up by the load hook, but also accessory load influences such as the weight of the load hook and/or harness and the hoisting cable weight varying depending on the length unwound. For example, when the load hook is deeply lowered from the crane boom, the weight fraction of the hoisting cable, which pulls on the cable drum as load, is very much greater than in situations in which the load hook is not lowered or only to a small extent and correspondingly a large amount of cable is wound up on the hoisting cable drum. Advantageously, the load detection device of the lifting device is configured such that as current hoisting load the sum of attached load weight, load hook weight and cable weight of the unwound hoisting cable length pulling on the hoisting gear is detected.

Advantageously, the load detection device can include a force measurement axis reeved into the hoisting cable of the hoisting gear, with which a load detector is associated in order to detect the force acting on the reeved force measurement axis. For example, said reeved force measurement axis can comprise a cable deflection pulley whose articulation point is shiftable and held via a force measuring device. For example, said deflection pulley can be held by a spring device so that a path measurement sensor also can detect the hoisting load acting on the hoisting cable via the displacement against the spring force. Alternatively or in addition, however, directly measuring force meters can also be used.

Advantageously, for determining the starting torque the lever arm of the hoisting cable with respect to the cable drum also is taken into account, in particular in the form of the number of winding layers of the hoisting cable present on the cable drum. When the hoisting cable in the first winding layer runs off directly from the grooving of the cable drum, the lever arm is smaller than when running off from the second or third winding layer. For this purpose, a winding layer sensor can detect the number of winding layers from which the hoisting cable runs off, wherein the winding layer detection can also be effected directly from the length of the cable unwound, as the hoisting gear controller knows the cable length and correspondingly can determine the winding layers or the lever arm from the unwound cable length and/or the height of the load hook.

In a development of the invention the variably adjustable starting torque can be calculated as a fraction of the nominal motor torque of the hoisting gear drive. From the calculated percentage of the nominal motor torque, which is required as starting torque in order to exactly compensate the hoisting load, the hoisting gear controller can determine a starting value for a frequency converter via which the hoisting gear drive is actuated. With the fixed starting value the frequency converter then actuates the hoisting gear drive such that when the brake is closed, the desired fraction of the nominal motor torque is built up as starting torque.

The starting torque can be built up by initializing the speed regulator against the still closed hoisting gear brake.

When the hoisting gear brake then is released, the hoisting force provided by the starting torque then more or less exactly compensates the hoisting load induced by the attached net load, the load hook weight and the cable weight of the unwound hoisting cable length so that a smooth start-up can be achieved without any pendular movements of the load.

BRIEF DESCRIPTION OF THE SEVERAL VIEWS OF THE DRAWINGS

The present invention will subsequently be explained in detail with reference to a preferred exemplary embodiment and associated drawings, in which.

DETAILED DESCRIPTION OF THE INVENTION

Figure 1:
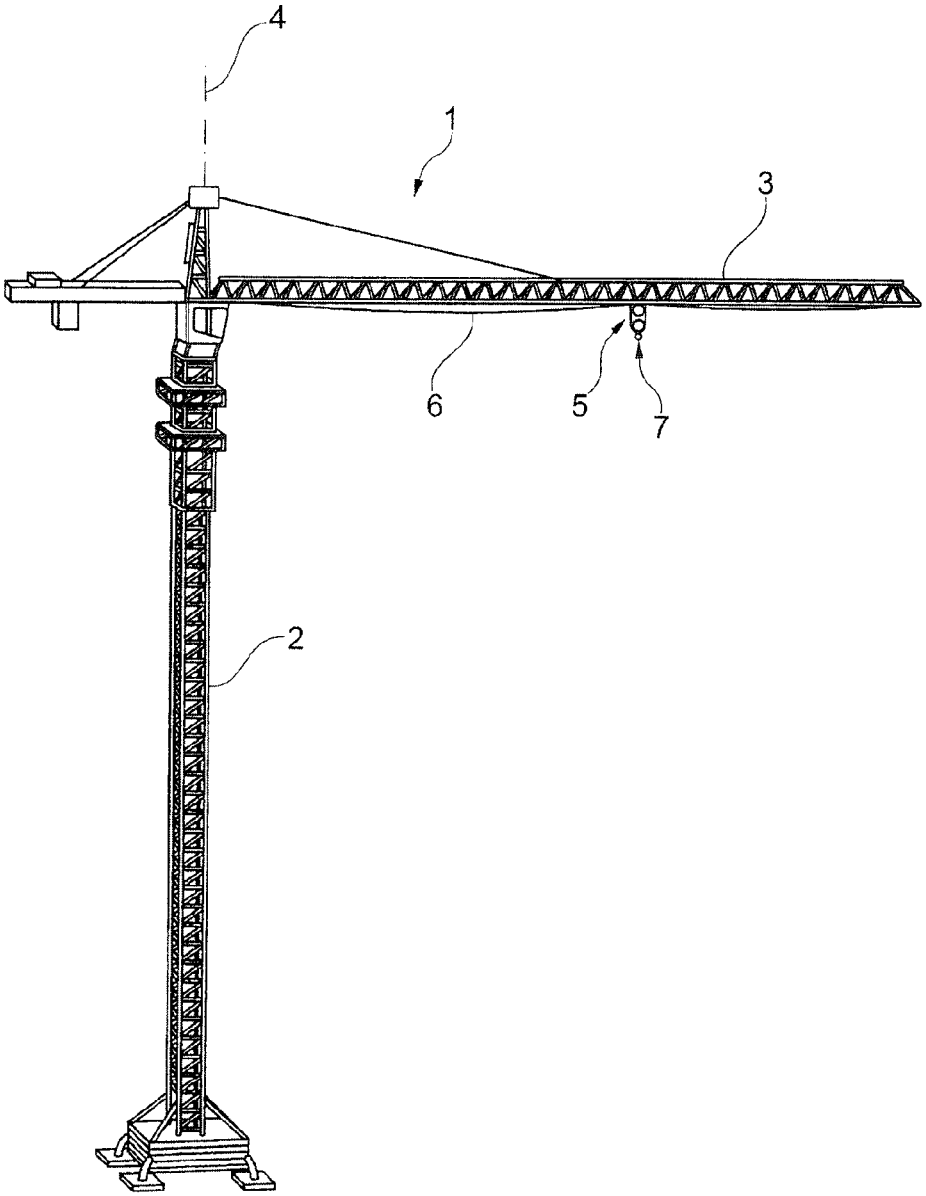
FIG. 1: shows a schematic representation of a lifting device in the form of a tower crane whose hoisting gear comprises a hoisting cable guided over a trolley.

As shown in FIG. 1, the lifting device 1 can be configured as a crane such as a tower crane and comprise a tower 2 which carries a boom 3 rotatable about an upright tower axis 4, from which a load hook 7 can be lowered and lifted. Said load hook 7 or a corresponding load harness is articulated to a hoisting cable 6 of a hoisting gear 8, wherein the hoisting cable 6 with the load hook 7 articulated thereto can be guided over a trolley 5 which is traversable along the boom 3.

Figure 2:
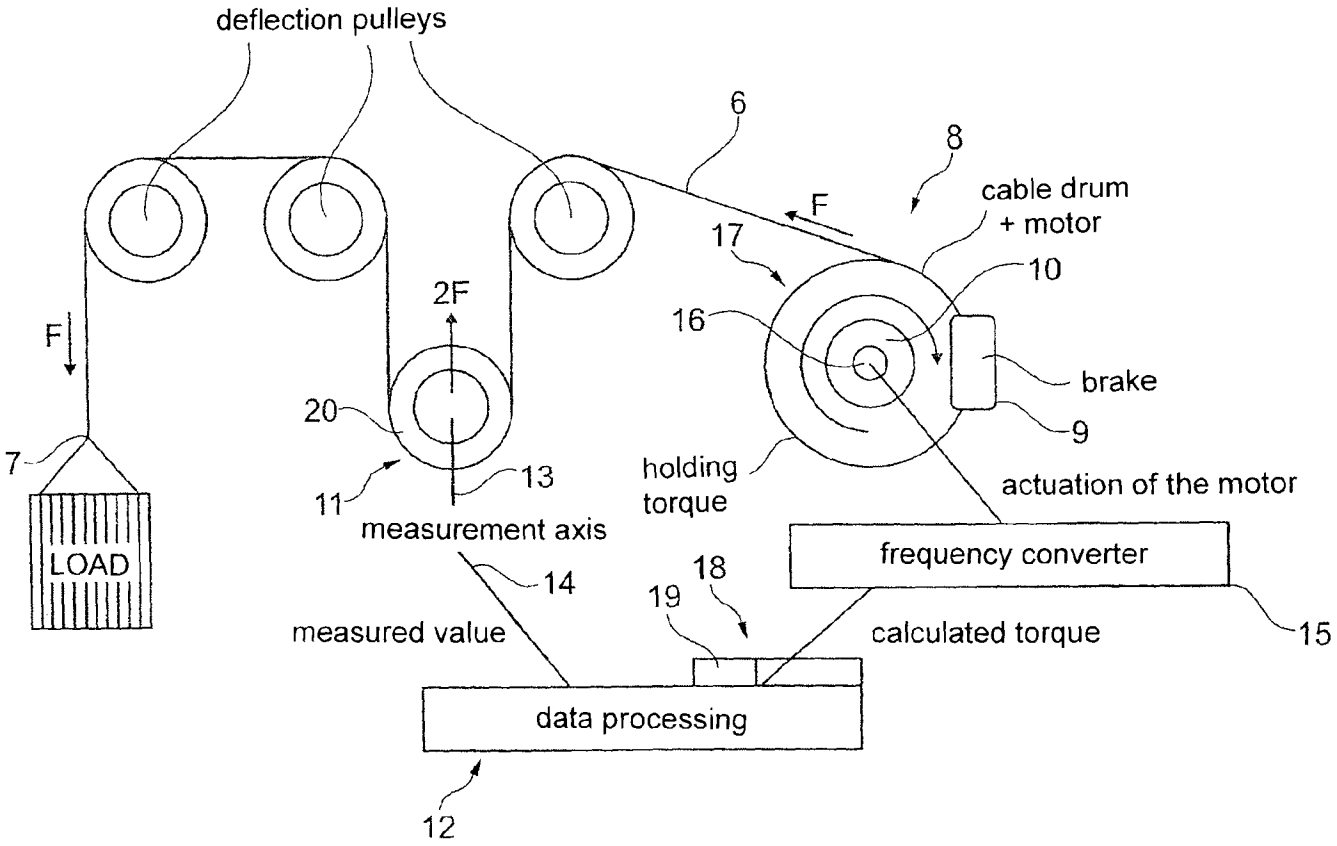
FIG. 2: shows a schematic representation of the hoisting gear of FIG. 1.

As shown in FIG. 2, the hoisting gear 8 comprises a hoisting gear drum 17 around which the hoisting cable 6 is wound in order to be let down and hauled. Said hoisting gear drum 17 can be driven rotatorily by a hoisting gear drive 10 which can be configured to operate electrically, for instance can comprise an electric motor which rotatorily drives the hoisting gear drum 17 via a possibly interposed transmission.

Said hoisting gear drive 10 advantageously can be actuated by a hoisting gear controller 12 via a frequency converter 15, in particular in order to control or regulate the speed and the torque of the hoisting gear drive 10.

Furthermore, the hoisting gear 8 comprises a hoisting gear brake 9 by means of which a hoisting load picked up on the load hook 7 can be held. Said hoisting gear brake 9 advantageously can engage the hoisting gear drum 17 or a transmission element connected therewith or can engage the hoisting gear drive 10 itself, wherein the hoisting gear brake 9 can be configured as a friction brake and/or as a locking brake. When the hoisting gear brake 9 is closed, the hoisting gear drum 17 is blocked and hence the load picked up is held stationary.

To achieve a smooth, jerk-free start-up on release of the hoisting gear brake 9, the hoisting gear controller 12 comprises a start-up control stage 18 which is intended to provide or build up a starting torque at the hoisting gear drive 10 when the hoisting gear brake 9 still is closed, which starting torque then intercepts the hoisting load on release of the hoisting gear brake 9 and at best exactly compensates the same.

To achieve the smooth, jerk-free start-up independent of the size of the load picked up and the load condition, in particular the hook height in each case, said starting torque is variably and individually adapted to the respective hoisting load condition. For this purpose, a load detection device 11 is provided, by means of which the hoisting load acting on the cable drum 17 when the hoisting gear brake 9 is closed is detected, namely advantageously including the net load attached to the load hook 7, the weight force of the load hook 7 itself, and the weight fraction of the unwound hoisting cable 6, which likewise tugs at the hoisting gear drum 17 and depends on the unwound hoisting cable length or the lowering depth of the load hook 7.

Said load detection device 11 advantageously comprises a force measurement axis 13 which is reeved into the hoisting cable 6, wherein said force measurement axis 13 can comprise a deflection pulley 20 whose articulation point can be shiftable in the direction of the reeving or the hoisting cable drum running off and can be connected or be operatively connected with a load detector 14. For example, said deflection pulley 20 can be shiftable under spring pretension so that the shifting path is a measure for the hoisting load and the load detector 14 can be a path detector. Alternatively or in addition, however, a direct force meter an also be provided at the force measurement axis 13.

Said force measurement axis 13 advantageously is associated with a portion of the unwinding path of the hoisting cable 6, which is located closer to the hoisting gear drum 17 than the cable portions running off and pulling on the hoisting gear drum 17 with their weight force, so that the weight force of the cable portions pulling on the hoisting gear drum 17 is included in the force measurement.

As shown in FIG. 2, the load detection device 11 is connected to the hoisting gear controller 12 which calculates the required starting torque from the currently detected hoisting load value in order to exactly balance out the respective hoisting load. As far as a plurality of layers can be wound on the hoisting gear drum 17 it is conceivable that for the calculation of the required starting torque the currently applicable lever arm of the hoisting cable 6 with respect to the hoisting gear drum 17 is taken into account, namely in particular in the form of the number of winding layers from which the hoisting cable runs off when the brake is to be released.

The starting torque advantageously is calculated exactly such that from the starting torque via the hoisting gear drum 17 a hoisting force can be induced into the hoisting cable 6, which hoisting force corresponds to the oppositely directed force F of the hoisting load.

In particular, said start-up control stage 18 of the hoisting gear controller 12 can include a starting torque adjusting device 19 which calculates the required starting torque in the form of a percentage of the nominal motor torque of the hoisting gear drive 10 and from this percentage of the nominal motor torque determines a starting value for the frequency converter 15 so that the frequency converter actuates the hoisting gear drive 10 such that the same builds up the desired starting torque against the closed hoisting gear brake 9. For this purpose, the speed regulator can be pre-initialized for the transmitted torque value so that the torque is still built up against the closed brake. When the starting torque built up is equal to the torque caused by the hoisting load, the brake is opened so that both torques even out and no undesired load hook movement occurs.

We claim:

1. A method for starting up a hoisting gear from a braked position in which a hoisting gear brake holds a hoisting load, wherein a starting torque is built up by a hoisting gear drive against the hoisting gear brake when the hoisting gear brake is closed, wherein the hoisting gear brake is released upon or after reaching the starting torque, wherein a current hoisting load is detected by a load detection device when the hoisting gear brake is closed, and wherein the starting torque is adjusted by a hoisting gear controller with reference to the current hoisting load such that a hoisting force provided by the starting torque of the hoisting gear corresponds to the current hoisting load, wherein the current hoisting load comprises the sum of an attached net load weight, a load hook weight, and a cable weight of an unwound hoisting cable length pulling on the hoisting gear.

2. The method according to claim 1, wherein the current hoisting load is detected by a force measurement axis reeved into a hoisting cable with which a load detector of the load detection device is associated.

3. The method according to claim 1, wherein the starting torque is calculated as a fraction of a nominal motor torque of the hoisting gear drive and wherein a starting value for a frequency converter actuating the hoisting gear drive is calculated from the calculated fraction of the nominal motor torque.

4. The method according to claim 1, wherein the starting torque is built up by initializing a speed sensor against the hoisting gear brake when the hoisting gear brake is closed.

5. The method according to claim 1, wherein the starting torque is variably adjusted in dependence on a detected unwound hoisting cable length of a hoisting cable and/or an accompanying number of winding layers of the hoisting cable on a hoisting gear drum.

6. A lifting device comprising:

a hoisting gear comprising a hoisting cable runnable from a hoisting gear drum drivable by a hoisting gear drive;

a hoisting gear brake and a hoisting gear controller, wherein the hoisting gear drive is actuatable by the hoisting gear controller, wherein the hoisting gear controller comprises a start-up control stage for starting up the hoisting gear from a braked position, wherein a starting torque at the hoisting gear drive is buildable by the startup control stage when the hoisting gear brake is closed; and a load detection device, wherein a current hoisting load when the hoisting gear brake is closed is detectable by the load detection device, wherein the start-up control stage comprises a starting torque adjuster, wherein the starting torque is variably adjustable in dependence on a detected current hoisting load such that a hoisting force providable by the starting torque of the hoisting gear corresponds to the detected current hoisting load, wherein the load detection device comprises a force measurement axis reeved into the hoisting cable with which a load detector is associated.

7. The lifting device according to claim 6, wherein the force measurement axis comprises a cable deflection pulley having an articulation point shiftably mounted and monitorable by the load detector.

8. The lifting device according to claim 6, wherein the hoisting gear controller comprises frequency converter, wherein the hoisting gear drive is actuatable by the frequency converter, wherein the starting torque as a fraction of a nominal motor torque of the hoisting gear drive is calculatable by the starting torque adjuster, and wherein a starting value for the frequency converter from a calculated fraction of the nominal motor torque is calculatable by the starting torque adjuster.

9. The lifting device according to claim 6, wherein the starting torque adjuster comprises a lever arm determiner, wherein a lever arm of the hoisting cable with respect to the hoisting gear drum is determinable via the lever arm determiner, wherein the starting torque in dependence on a determined lever arm is determinable by the lever arm determiner, and wherein the lever arm is calculatable by the lever arm determiner from an unwound hoisting cable length and/or a detected number of winding layers on the hoisting gear drum.

10. The lifting device according to claim 6, wherein the lifting device comprises a crane, a tower crane, or a telescopic crane.

11. A method for starting up a hoisting gear from a braked position in which a hoisting gear brake holds a hoisting load, wherein a starting torque is built up by a hoisting gear drive against the hoisting gear brake when the hoisting gear brake is closed, wherein the hoisting gear brake is released upon or after reaching the starting torque, wherein a current hoisting load is detected by a load detection device when the hoisting gear brake is closed, and wherein the starting torque is adjusted by a hoisting gear controller with reference to the current hoisting load such that a hoisting force provided by the starting torque of the hoisting gear corresponds to the current hoisting load, wherein the current hoisting load is detected by a force measurement axis reeved into a hoisting cable with which a load detector of the load detection device is associated.

12. The method according to claim 11, wherein the starting torque is calculated as a fraction of a nominal motor torque of the hoisting gear drive, and wherein a starting value for a frequency converter actuating the hoisting gear drive is calculated from the calculated fraction of the nominal motor torque.

13. The method according to claim 11, wherein the starting torque is built up by initializing a speed sensor against the hoisting gear brake when the hoisting gear brake is closed.

14. The method according to claim 11, wherein the starting torque is variably adjusted in dependence on a detected unwound hoisting cable length of a hoisting cable and/or an accompanying number of winding layers of the hoisting cable on a hoisting gear drum.

15. A method for starting up a hoisting gear from a braked position in which a hoisting gear brake holds a hoisting load, wherein a starting torque is built up by a hoisting gear drive against the hoisting gear brake when the hoisting gear brake is closed, wherein the hoisting gear brake is released upon or after reaching the starting torque, wherein a current hoisting load is detected by a load detection device when the hoisting gear brake is closed, and wherein the starting torque is adjusted by a hoisting gear controller with reference to the current hoisting load such that a hoisting force provided by the starting torque of the hoisting gear corresponds to the current hoisting load, wherein the starting torque is variably adjusted in dependence on a detected unwound hoisting cable length of a hoisting cable and/or an accompanying number of winding layers of the hoisting cable on a hoisting gear drum.

16. The method according to claim 15, wherein the starting torque is calculated as a fraction of a nominal motor torque of the hoisting gear drive, and wherein a starting value for a frequency converter actuating the hoisting gear drive is calculated from the calculated fraction of the nominal motor torque.

17. The method according to claim 15, wherein the starting torque is built up by initializing a speed sensor against the hoisting gear brake when the hoisting gear brake is closed.

18. A lifting device comprising:

a hoisting gear comprising a hoisting cable runnable from a hoisting gear drum drivable by a hoisting gear drive;

a hoisting gear brake and a hoisting gear controller, wherein the hoisting gear drive is actuatable by the hoisting gear controller, wherein the hoisting gear controller comprises a start-up control stage for starting up the hoisting gear from a braked position, wherein a starting torque at the hoisting gear drive is buildable by the startup control stage when the hoisting gear brake is closed; and a load detection device, wherein a current hoisting load when the hoisting gear brake is closed is detectable by the load detection device, wherein the start-up control stage comprises a starting torque adjuster, wherein the starting torque is variably adjustable in dependence on a detected current hoisting load such that a hoisting force providable by the starting torque of the hoisting gear corresponds to the detected current hoisting load, wherein the hoisting gear controller comprises a frequency converter, wherein the hoisting gear drive is actuatable by the frequency converter, wherein the starting torque as a fraction of a nominal motor torque of the hoisting gear drive is calculatable by the starting torque adjuster, and wherein a starting value for the frequency converter from a calculated fraction of the nominal motor torque is calculatable by the starting torque adjuster.

19. The lifting device according to claim 18, wherein the starting torque adjuster comprises a lever arm determiner, wherein a lever arm of the hoisting cable with respect to the hoisting gear drum is determinable via the lever arm determiner, wherein the starting torque in dependence on a determined lever arm is determinable by the lever arm determiner, and wherein the lever arm is calculatable by the lever arm determiner from an unwound hoisting cable length and/or a detected number of winding layers on the hoisting gear drum.

20. A lifting device comprising:

a hoisting gear comprising a hoisting cable runnable from a hoisting gear drum drivable by a hoisting gear drive;

a hoisting gear brake and a hoisting gear controller, wherein the hoisting gear drive is actuatable by the hoisting gear controller, wherein the hoisting gear controller comprises a start-up control stage for starting up the hoisting gear from a braked position, wherein a starting torque at the hoisting gear drive is buildable by the startup control stage when the hoisting gear brake is closed; and a load detection device, wherein a current hoisting load when the hoisting gear brake is closed is detectable by the load detection device, wherein the start-up control stage comprises a starting torque adjuster, wherein the starting torque is variably adjustable in dependence on a detected current hoisting load such that a hoisting force providable by the starting torque of the hoisting gear corresponds to the detected current hoisting load, wherein the starting torque adjuster comprises a lever arm determiner, wherein a lever arm of the hoisting cable with respect to the hoisting gear drum is determinable via the lever arm determiner, wherein the starting torque in dependence on a determined lever arm is determinable by the lever arm determiner, and wherein the lever arm is calculatable by the lever arm determiner from an unwound hoisting cable length and/or a detected number of winding layers on the hoisting gear drum.

* * * * *